US011970823B2

(12) United States Patent
Appleford et al.

(10) Patent No.: US 11,970,823 B2
(45) Date of Patent: Apr. 30, 2024

(54) MOULDED PULP FIBRE PRODUCT FORMING SYSTEM, APPARATUS, AND PROCESS

(71) Applicant: VARDEN PROCESS PTY LTD, Victoria (AU)

(72) Inventors: Mark Appleford, Victoria (AU); Stuart Gordon, Victoria (AU)

(73) Assignee: VARDEN PROCESS PTY LTD, Victoria (AU)

( * ) Notice: Subject to any disclaimer, the term of this patent is extended or adjusted under 35 U.S.C. 154(b) by 187 days.

(21) Appl. No.: 17/310,196

(22) PCT Filed: Jan. 23, 2020

(86) PCT No.: PCT/AU2020/050039
§ 371 (c)(1),
(2) Date: Jul. 26, 2021

(87) PCT Pub. No.: WO2020/150779
PCT Pub. Date: Jul. 30, 2020

(65) Prior Publication Data

US 2022/0162805 A1 May 26, 2022

(30) Foreign Application Priority Data

Jan. 24, 2019 (AU) ..... 2019900218

(51) Int. Cl.
*D21J 3/00* (2006.01)
*B65B 47/10* (2006.01)
*D21J 7/00* (2006.01)

(52) U.S. Cl.
CPC ..... *D21J 3/00* (2013.01); *B65B 47/10* (2013.01); *D21J 7/00* (2013.01)

(58) Field of Classification Search
CPC ..... D21J 3/00; D21J 7/00; B65B 47/10
See application file for complete search history.

(56) References Cited

U.S. PATENT DOCUMENTS 1,848,055 A 3/1932 Chaplin
3,373,079 A * 3/1968 Eastman ..... B27N 5/02 425/134

(Continued)

FOREIGN PATENT DOCUMENTS

BR 112021014288 A2 * 9/2021 ..... B65B 47/10
CA 2439350 C * 7/2007 ..... D21F 11/002

(Continued)

OTHER PUBLICATIONS

International Search Report and Written Opinion from PCT Application No. PCT/AU2020/050039, dated Mar. 13, 2020.

(Continued)

*Primary Examiner* — Jose A Fortuna
(74) *Attorney, Agent, or Firm* — Workman Nydegger

(57) ABSTRACT

A process for forming a pre-form for a moulded pulp fibre product involves providing a porous mould that has one or more pre-form mould portions that each have an outer surface corresponding to a surface of the pre-form. Pulp fibre slurry is discharged from an outlet; each pre-form mould portion is coated with discharged pulp fibre slurry by moving the porous mould relative to the outlet. Thus, a slurry deposit for the pre-form is formed on the outer surfaces of the pre-form mould portions. Fluid from the slurry deposit is extracted through the porous mould to form the pre-form.

15 Claims, 14 Drawing Sheets

(56) References Cited

U.S. PATENT DOCUMENTS

| | | | | |
|---|---|---|---|---|
| 3,890,195 | A | 6/1975 | Lee et al. | |
| 5,904,809 | A * | 5/1999 | Rokman | D21F 11/002 162/190 |
| 6,432,482 | B1 | 8/2002 | Jaffee et al. | |
| 6,451,235 | B1 * | 9/2002 | Owens | D21J 3/00 425/84 |
| 6,531,078 | B2 * | 3/2003 | Laine | D21F 11/002 264/122 |
| 9,951,478 | B2 * | 4/2018 | Kuo | D21J 3/00 |
| 2002/0117768 | A1 * | 8/2002 | Laine | D21F 11/002 264/45.8 |
| 2017/0320233 | A1 * | 11/2017 | Franke | B28B 1/265 |
| 2021/0292974 | A1 * | 9/2021 | Pierce | B32B 23/10 |
| 2022/0162805 | A1 * | 5/2022 | Appleford | B65B 47/10 |

FOREIGN PATENT DOCUMENTS

| | | | | |
|---|---|---|---|---|
| DE | 60224653 | T2 * | 1/2009 | D21F 11/002 |
| EP | 1217107 | A1 | 6/2002 | |
| EP | 1373620 | B1 * | 1/2008 | D21F 11/002 |
| EP | 1373620 | B1 | 1/2008 | |
| JP | 2008522044 | A * | 6/2008 | D21J 3/00 |
| MY | 137142 | A * | 12/2008 | D21J 3/10 |
| WO | WO-02068743 | A8 * | 11/2003 | D21F 11/002 |
| WO | 2018049460 | A1 | 3/2018 | |

OTHER PUBLICATIONS

Search Report from European Application No. 20744899.4, dated Oct. 24, 2022.

* cited by examiner

MOULDED PULP FIBRE PRODUCT FORMING SYSTEM, APPARATUS, AND PROCESS

FIELD OF THE INVENTION

The present invention relates to moulded pulp fibre product forming apparatus, and to a process for forming moulded pulp fibre products. More particularly, the invention relates to a process for forming a pre-form for a moulded pulp fibre product, and to apparatus for forming a pre-form for a moulded pulp fibre product.

BACKGROUND

Moulded pulp fibre is well known for use in egg cartons, but is also used to form other packaging products, and single use food and beverage service trays/containers, and transport products. To this end, moulded pulp fibre products can be "sustainable" when made from materials that enable the product to be recycled or otherwise composted, after the product's useful life. In addition, moulded pulp fibre products can be less expensive than equivalent products made of plastics materials.

A widely-utilized process (hereinafter referred to as the "basic process") for forming moulded pulp fibre products involves:

1. creating a slurry of fibrous material and liquid in an open tank;
2. immersing a forming head into the slurry, the forming head having a shaped mesh mould;
3. applying suction to the forming head, so as to draw the slurry onto the mesh mould, whereby a wet pulp pre-form of the final moulded pulp fibre product is formed on the mesh mould; and
4. removing the forming head from the open tank, while maintaining a suction pressure to hold the pre-form on the mesh mould.

In step 3 above, liquid in the slurry is drawn through the mesh mould (following the pressure drop across the mesh mould), leaving wet pulp fibre on the slurry side. The pore size in the mesh mould is selected to enable liquid to pass through the mesh readily, while blocking passage of the pulp fibres. The wall thickness of the pre-form is largely dependent on the properties of the slurry (and, in particular, the properties of the pulp fibre), and of the suction pressure.

It will be appreciated that a slurry of fibrous material and liquid can include one or more fibrous materials, and one or more liquids. Further the slurry may include additive materials that are dissolved or suspended within the liquid.

After step 4 above, the wet pulp pre-form is then released from the forming head, and the pulp pre-form baked to dry the pre-form to the final product shape. The baking process fixes the bonds between pulp fibres within the pulp pre-form, such that the final product has the desired structural integrity.

The above described basic process forms a product that has a moderate surface finish on a first side—being the side that was against the mesh mould during step 3 above—and a very coarse surface finish on the second (opposing) side. The basic process can be augmented by incorporating a transfer mould that receives the wet pulp pre-form from the mesh mould. The wet pulp pre-form is drawn against the transfer mould by further application of suction. The incorporation of the transfer mould has the benefit of smoothing of the second side of the product, and reducing the wall thickness of the final product. However, the second side typically retains a rough surface finish. One example of a product formed using this augmented version of the basic process is an egg carton.

A further modified process for forming moulded pulp fibre products is known as "thermoforming". This process utilizes a toolset of two (or more) complementary moulds that are heated, and the wet pulp pre-form is compressed between the complementary moulds.

Thermoforming processes can form products with thinner walls, greater structural integrity, and smoother surface finishes, compared with the basic processes. The formation of the wet pulp pre-form in the thermoforming processes typically involves a similar process to steps 1 to 4 described above in connection with the basic process.

Both the basic and thermoforming processes are limited by the batch-type production of the wet pulp pre-forms. Attempts have been made to increase production rates by operating multiple forming heads that concurrently undertake different stages of the pre-form production process. While this approach can increase the production rates, there are limitations.

There is a need to address the above, and/or at least provide a useful alternative.

Summary

The present invention provides a process for forming a pre-form for a moulded pulp fibre product, the process involving:

providing a porous mould having one or more pre-form mould portions that each have an outer surface corresponding to a surface of the pre-form;

discharging pulp fibre slurry from an outlet;

coating each pre-form mould portion with discharged pulp fibre slurry by moving the porous mould relative to the outlet to thereby form a slurry deposit for the pre-form on the outer surfaces of the pre-form mould portions; and extracting fluid from the slurry deposit through the porous mould to form the pre-form.

Preferably, the outlet is arranged so that pulp fibre slurry is discharged from the outlet towards the porous mould in a curtain of pulp fibre slurry. More preferably, the curtain descends towards the porous mould.

In at least some embodiments, the pre-form mould portions are moved in a direction that is transverse relative to the width direction of the curtain.

In certain embodiments, the pre-form mould portions are part of a continuous belt, whereby the coating step involves driving the continuous belt to move the pre-form mould portions through the curtain. In at least some alternative embodiments, the pre-form mould portions are provided on a plurality of toolsets, whereby during operation of the process, the toolsets are moved sequentially and substantially continuously with respect to the outlet.

Extracting fluid from the slurry deposit through the respective pre-form mould portion can further involve applying suction to the porous mould to draw fluid from the deposited slurry. The process can further involve applying suction for a period after each pre-form mould portion passes through the curtain.

In at least some embodiments, the process can further involve, after the coating step, directing water onto the slurry deposit to remove pulp fibres that are not held to the pre-form mould portions by the applied suction pressure, and/or to remove pulp fibres from portions of the porous mould that surround the pre-form mould portions.

In some embodiments, the process further involves, after the coating step, positioning a conformable material on the surface of the slurry deposit such that the slurry deposit is between the pre-form mould portion and the conformable material, wherein, when the conformable material is in contact with the slurry deposit, suction applied to the pre-form mould portion draws the conformable material towards the pre-form mould portion to thereby squeeze the slurry deposit between the conformable material and the pre-form mould portion.

In some embodiments in which the process involves positioning a conformable material onto the surface of the slurry deposit, the conformable material is permeable to air, and the process further involves directing heated air onto the conformable material whilst the conformable material is in contact with the slurry deposit and suction is applied to the pre-form mould portion.

Alternatively or additionally, the process can involve heating the slurry deposit to thereby evaporate liquid from the slurry deposit. Heating the slurry deposit can involve any one or more of: directing heated air towards the slurry deposit, exposing the slurry deposit to radiant heat, heating the porous mould toolset, and directing microwave and/or ultrasound energy towards the slurry deposit.

In certain embodiments, the process can involve providing a heated tool having a contact surface with a shape that is complementary of the outer surface of the pre-form mould portion and, after the coating step, engaging the slurry deposit with the contact surface to thereby transfer heat from the heated tool to the slurry deposit. Engaging the slurry deposit with the contact surface can occur while suction is applied to the pre-form mould portion. The heated tool can be porous, and the process can further involve applying suction to the heated tool to extract fluid from the slurry deposit through the heated tool. The heated tool can also operate as a transfer tool for use in transferring pulp fibre pre-forms from the porous mould.

In some embodiments, the process further involves varying the applied suction pressure as the porous mould moves relative to the outlet. The process can alternatively or additionally involve varying the flow rate of pulp fibre slurry discharged from the outlet as the porous mould moves relative to the outlet. The flow rate of pulp fibre slurry can be varied so as to maintain a constant in relation to the suction pressure to reduce variation in the adhesion of pulp fibres to the pre-form mould portions.

In some embodiments, the process can further involve adjusting the vertical position of the outlet as the porous mould moves relative to the outlet to maintain the vertical separation of the outlet and the outer surface of the pre-form mould portion within a predetermined maximum separation.

The present invention also provides a process for forming a moulded pulp fibre product, the process involving:

forming a pre-form for a moulded pulp fibre product by the process described above;

transferring the pre-form to a secondary toolset that has two complementary shaped surfaces between which the pre-form is to be loaded;

curing the pre-form within the secondary toolset and forming the moulded pulp fibre product.

In some embodiments, curing the pre-form involves heating the secondary toolset to transfer heat from the secondary toolset to the pre-form, thereby liberating fluid from the pre-form. Alternatively or additionally, curing the pre-form involves squeezing the pre-form between the two complementary surfaces, thereby forcing fluid from the pre-form.

Liberating liquid from the pre-form can involve heating the secondary tool set to cause water to transition to steam.

In certain embodiments, the secondary toolset has two fluid paths that each extend from a respective one of the complementary surfaces, and the process further involves applying suction to the fluid paths to urge fluid that is liberated and/or liquid that is forced from the pre-form to migrate away from the pre-form.

The present invention also provides an apparatus for forming a pre-form for a moulded pulp fibre product, the apparatus comprising:

a porous mould having one or more pre-form mould portions that each have an outer surface corresponding to a surface of the pre-form;

a source of pulp fibre slurry, and an outlet that is in communication with the source such that pulp fibre slurry from the source is to be discharged from the outlet;

a drive that is arranged to move the porous mould relative to the outlet and/or the outlet relative to the porous mould such that pulp fibre slurry discharged from the outlet forms slurry deposits for the pre-forms on the outer surfaces of the pre-form mould portions; and a fluid extraction system that is configured to extract fluid from the slurry deposits through the porous mould to thereby form the pre-form.

Preferably, the outlet is arranged so that pulp fibre slurry is discharged from the outlet towards the porous mould in a curtain of pulp fibre slurry. More preferably, the outlet is arranged so that the width of the curtain is generally transverse to the direction of movement of the porous mould relative to the outlet.

In at least some embodiments, the apparatus is configured so that each pre-form mould portion is vertically beneath the outlet when a slurry deposit is formed on the respective pre-form mould portion.

In certain embodiments, the pre-form mould portions are part of a continuous belt assembly that is driven by the drive to move the pre-form mould portions relative to the outlet.

Preferably, the belt assembly is arranged to have a feed path during which pulp fibre slurry is discharged onto the pre-form mould portions, and a return path.

In some embodiments, the apparatus includes a belt support assembly, and the belt support assembly is arranged to support the belt assembly within at least a first portion of the feed path, and the belt support assembly has an upper surface that slopes in a direction perpendicular to a centreline of the belt support assembly such that fluid drains away from the centreline, wherein the first portion of the feed path includes a region that is beneath the outlet. In certain embodiments, the slope of the upper surface on each side of the centreline is constant.

In some alternative embodiments in which the pre-form mould portions are part of a belt assembly, the apparatus is arranged such that the cross section of the belt assembly is shaped such that the surface of the belt assembly that is oriented towards the outlet when the slurry is deposited on the pre-form mould portions is sloped in a direction perpendicular to a centreline of the belt, whereby fluid drains across that surface and away from the centreline.

The belt assembly can include a plurality of carriage plates, each pre-form mould portion being attached to, or integrally formed with a respective one of the carriage plates, wherein the drive is configured to move the carriage plates sequentially along a loop that includes a feed path within which pulp fibre slurry is discharged onto the pre-form mould portions, and a return path. Preferably, the belt assembly includes a flexible substrate that interconnects adjacent pairs of carriage plates, wherein the flexible substrate is formed of a non-porous material.

In certain alternative embodiments, the belt assembly can include a flexible substrate to which the pre-form mould portions are attached. In some examples, the flexible substrate is formed of a non-porous material.

The belt assembly can further include one or more flexible drive elements to which the carriage plates are connected, and the drive includes rotational elements to support the belt assembly, and drive the belt assembly along the loop.

Preferably, each carriage plate has one or more alignment formations to facilitate lateral alignment of the respective carriage plate through the feed path of the loop. The alignment formations can include one or more side plates on each carriage plate, the side plates being disposed on the opposing side of the respective carriage plate to the pre-form mould portions, and the belt support assembly includes complementary elongate formations that co-operate with the side plates to laterally align the carriage plates.

Alternatively or additionally, each carriage plate includes a leading end and a trailing end, and the alignment formations include complementary interengaging formations on each of the leading and trailing ends, whereby, when the leading end and the trailing end of adjacent carriage plates abut one another, the interengaging formations align and locate the adjacent carriage plates.

In some embodiments, the apparatus is arranged such that at least a second portion of the feed path is longitudinally inclined to the horizontal, wherein that second portion includes a region of the feed path that is beneath the outlet. In some embodiments, the apparatus is arranged such that the whole feed path is longitudinally inclined to the horizontal. Preferably, at least the second portion of the feed path has the pre-form mould portions rising as they pass beneath the outlet. In certain embodiments, the longitudinal inclination of feed path, at least within the second portion of the feed path, is variable. More preferably, the longitudinal inclination of the belt assembly is variable between 0° and 15°.

Preferably, the fluid extraction system includes:

a duct that has an inlet end that is positioned to receive fluid from slurry deposits that are on the pre-form mould portions, and an outlet end; and a vacuum pump that is interconnected with the outlet end of the duct, the vacuum pump is operable to induce a low pressure within the duct, whereby, in use of the apparatus, low pressure induced within the duct draws fluid from a region immediately above the porous mould and into the duct via the inlet end for discharge at the outlet end, to thereby retain pulp fibre from the slurry deposits against the pre-form mould portions.

In one form, the apparatus includes a support bed across which the belt assembly is to traverse, the support bed extending along at least a support bed portion of the feed path, wherein the support bed portion includes a vertical plane that is transverse to the feed path and coincident with the outlet, wherein the support bed has a plenum chamber, and one or more through-holes such that the plenum chamber is in communication with the region immediately above the belt assembly.

The diameter of the through-holes can be varied along the support bed portion in the direction of the feed path. In some embodiments, the diameter of the through-holes is selected such that, in use of the apparatus, the suction pressure is substantially constant along the support bed portion. In certain alternative embodiments, the diameter of the through-holes is selected to provide increasing suction pressure along the support bed portion in the forward direction of the feed path.

Each pre-form mould portion can include two or more regions, wherein the pore size and/or pore density differs between the regions so as to provide differing maximum flow rate of fluid through the regions. Preferably, the pore size and/or pore density of each pre-form mould portion is proportional to the local inclination of the outer surface of the respective pre-form mould portion to a support plane that is defined by a surface of the belt assembly to which the respective pre-form mould portion is attached. Alternatively or additionally, the pore size and/or pore density of each pre-form mould portion increases with increasing local inclination of the outer surface of the respective pre-form mould portion relative to the support plane.

The apparatus can further comprise a pulp fibre slurry run-off drainage and collection system.

The apparatus can further comprise an air knife that is positioned downstream of the outlet, wherein in use of the apparatus the air knife blows air to facilitate migration of excess pulp fibre slurry from the slurry deposits and/or the porous mould towards the pulp fibre slurry run-off drainage and collection system. In some embodiments, the air knife is configured to blow air at a temperature above the ambient air temperature.

Alternatively or additionally the apparatus can further comprise a liquid spray system that includes liquid discharge nozzles that are positioned downstream of the outlet, wherein in use of the apparatus the liquid spray system facilitates migration of excess pulp fibre slurry from the slurry deposits and/or the porous mould towards the pulp fibre slurry run-off drainage and collection system.

The apparatus can further comprise a conforming tool that includes one or more receptacle portions that each have a working surface with a shape that is complementary to the shape of the pre-form mould portions, wherein:

each receptacle portion is made of a conformable material;

the conforming tool is configured to position the receptacle portions over the slurry deposits, with the working surface contacting the surfaces of the slurry deposits that are opposite the pre-form mould portions;

when the conformable material is in contact with the slurry deposits, suction applied to the pre-form mould portions by the fluid extraction system draws the receptacle portions of the conformable material towards the pre-form mould portion to thereby squeeze the slurry deposits between the receptacle portions and the pre-form mould portions.

Preferably, the receptacle portions are mounted so as to be movable along the feed path synchronously with the movement of pre-form mould portions along the feed path. In certain embodiments, the receptacle portions are made of an air impermeable material. The receptacle portions can have apertures formed in the air impermeable material to selectively allow transmission of air through the receptacle portions.

The conforming tool can further comprise a conforming tool drive for moving the receptacle portions synchronously with the pre-form mould portions along the feed path in use of the apparatus. Alternatively or additionally, the conforming tool drive includes an alignment subsystem that is configured to adjust the longitudinal position of the receptacle portions to maintain alignment of the receptacle portions with the pre-form mould portions along the feed path.

The apparatus can further comprise an actuator assembly on which the outlet is supported, wherein the actuator assembly is operable to vary the height of outlet in use of the apparatus. In some embodiments, the actuator assembly is operable to vary the height in response to the position of pre-mould portions relative to the support bed.

Preferably, the source of pulp fibre slurry includes a header tank that defines an internal chamber that is substantially isolated from the environment, and wherein the apparatus includes a discharge conduit that leads from the internal chamber to the outlet.

In some embodiments, the internal chamber is positively pressurized. The positive pressure within the internal chamber facilitates movement of pulp fibre slurry through the discharge conduit.

The apparatus can include a slurry mixer that agitates pulp fibre slurry within the internal chamber to maintain a consistent dispersion of fibre within the liquid.

In some embodiments, the outlet is an orifice, and the apparatus includes a restriction plate that is operable to restrict the flow rate of pulp fibre slurry through the orifice, and/or selectively cease discharge of pulp fibre slurry from the orifice.

BRIEF DESCRIPTION OF THE DRAWINGS

In order that the invention may be more easily understood, embodiments will now be described, by way of example only, with reference to the accompanying drawings, in which.

DETAILED DESCRIPTION

FIGS. 1 to 7 show an apparatus 10 for forming pre-forms for a moulded pulp fibre product, the apparatus being in accordance with an embodiment. The apparatus 10 has a source 12 of pulp fibre slurry with an outlet 14 that is in communication with the source 12 such that pulp fibre slurry from the source 12 is to be discharged from the outlet 14. The apparatus 10 has a porous mould and a drive; in this particular embodiment, the drive is arranged to move the porous mould relative to the outlet 14.

Figure 1:
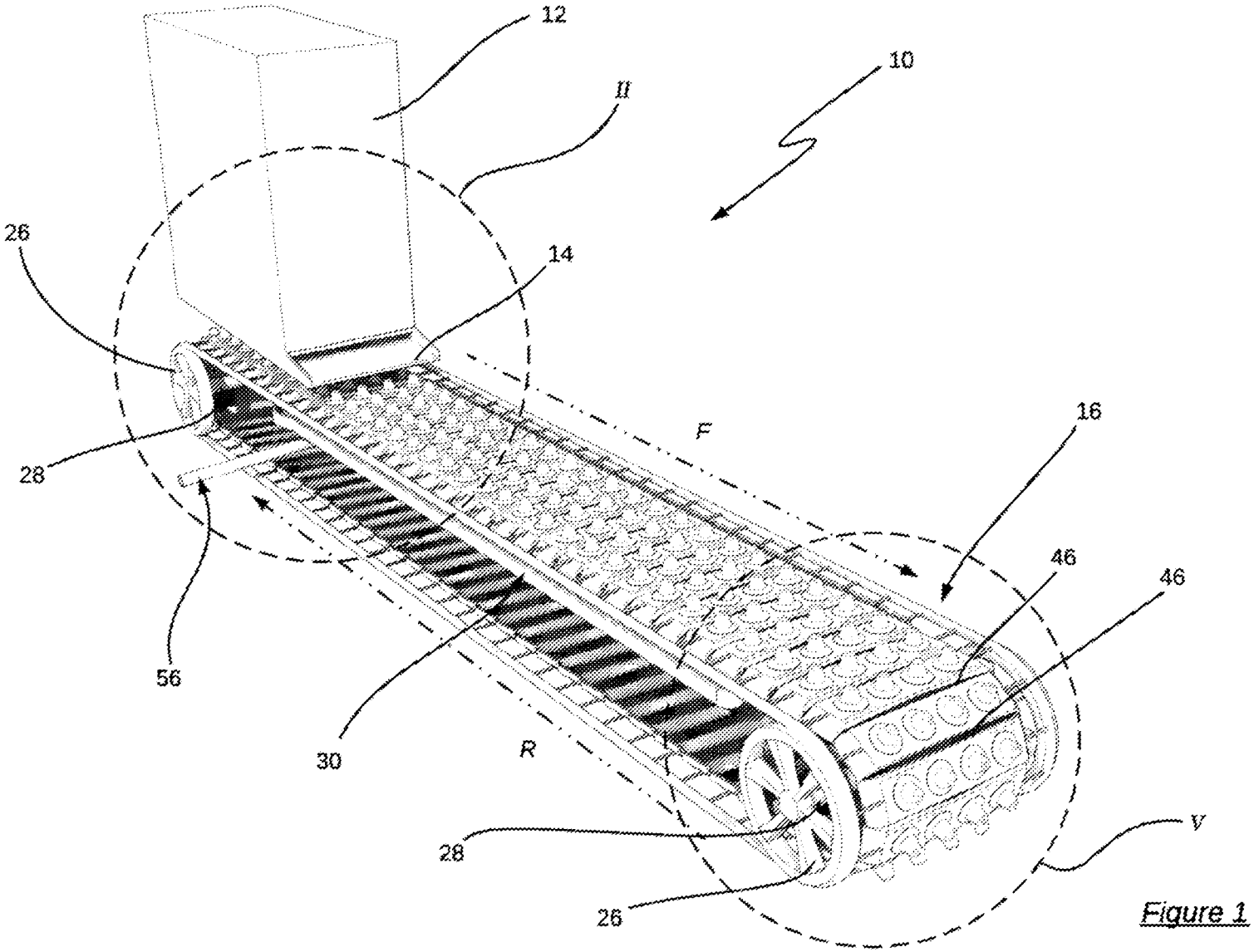
FIG. 1: is a perspective view of an apparatus for forming a pre-form for a moulded pulp fibre product, the apparatus being in accordance with a first embodiment of the present invention.
Figure 2:
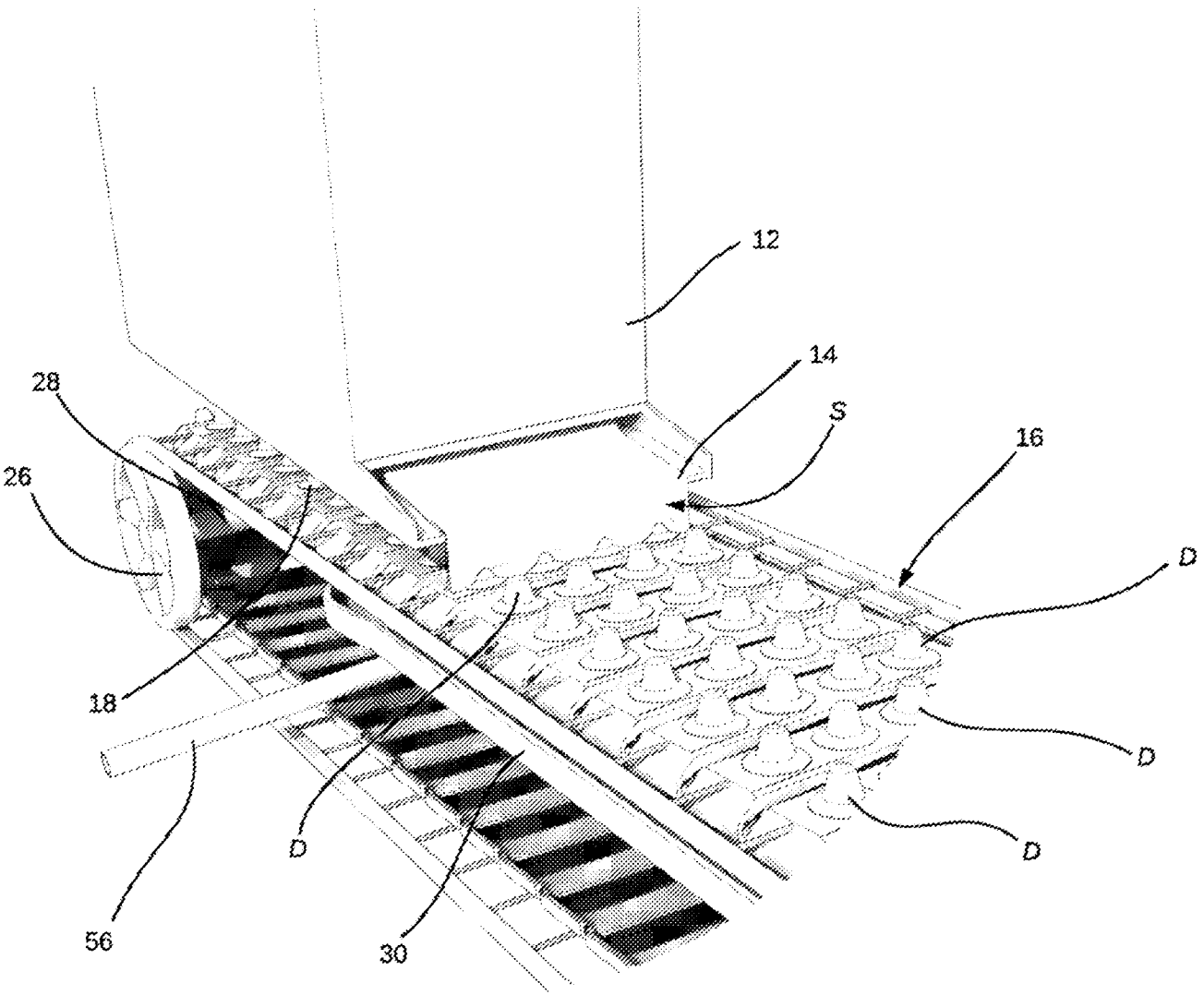
FIG. 2: is an enlarged view of Region II in FIG. 1.
Figure 3:
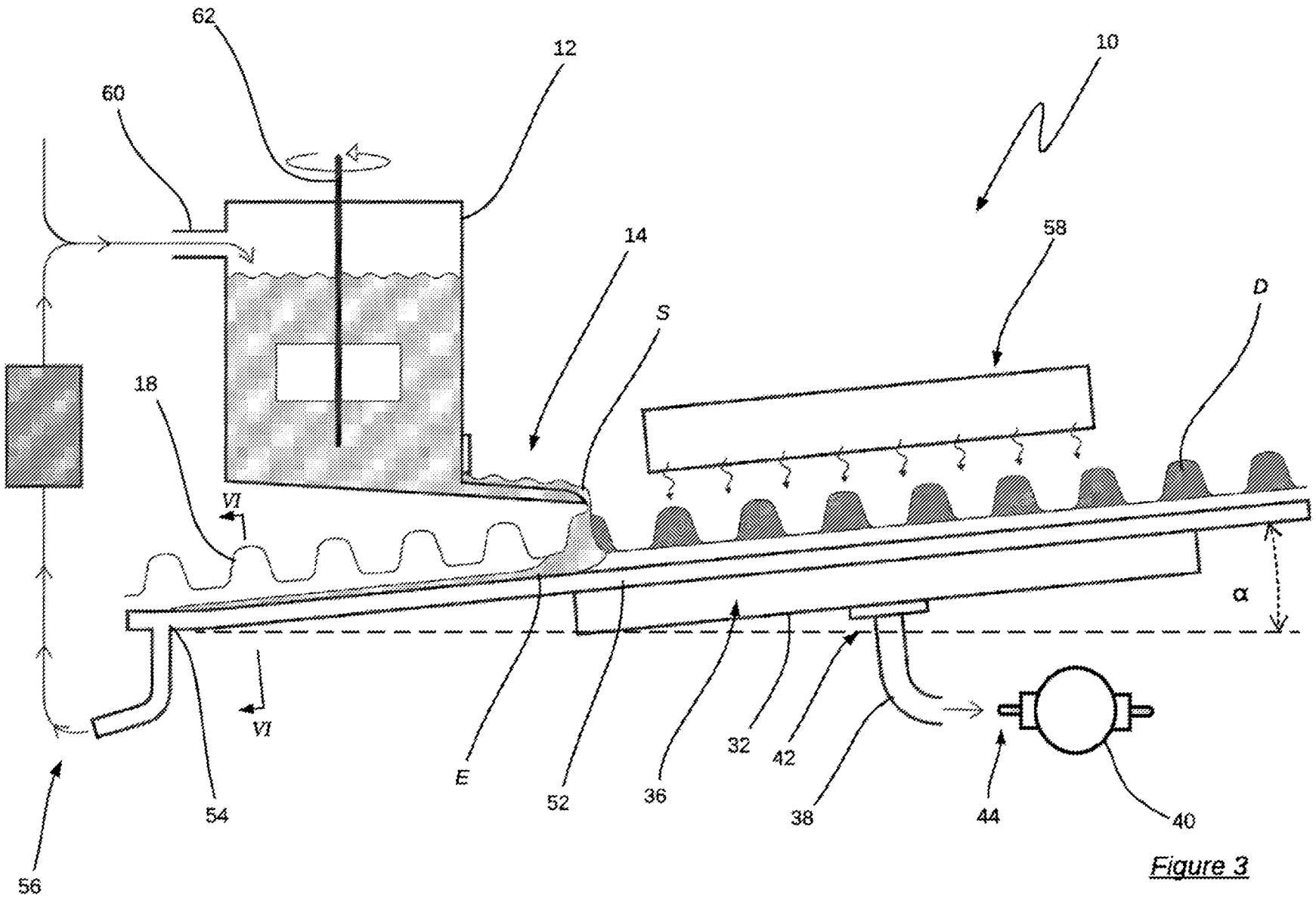
FIG. 3: is a side view of the apparatus of FIG. 1.

As shown in FIGS. 2 and 3, in use of the apparatus 10, pulp fibre slurry S is discharged from the outlet 14 and onto the porous mould. Slurry deposits D form on the upwardly oriented surfaces of the porous mould, from which pre-forms for the moulded pulp fibre products are formed, as described in further detail below.

The apparatus 10 also has a fluid extraction system (described in further detail below) that is configured to extract fluid from the slurry deposits D through the porous mould to thereby form the pre-forms.

Figure 7:
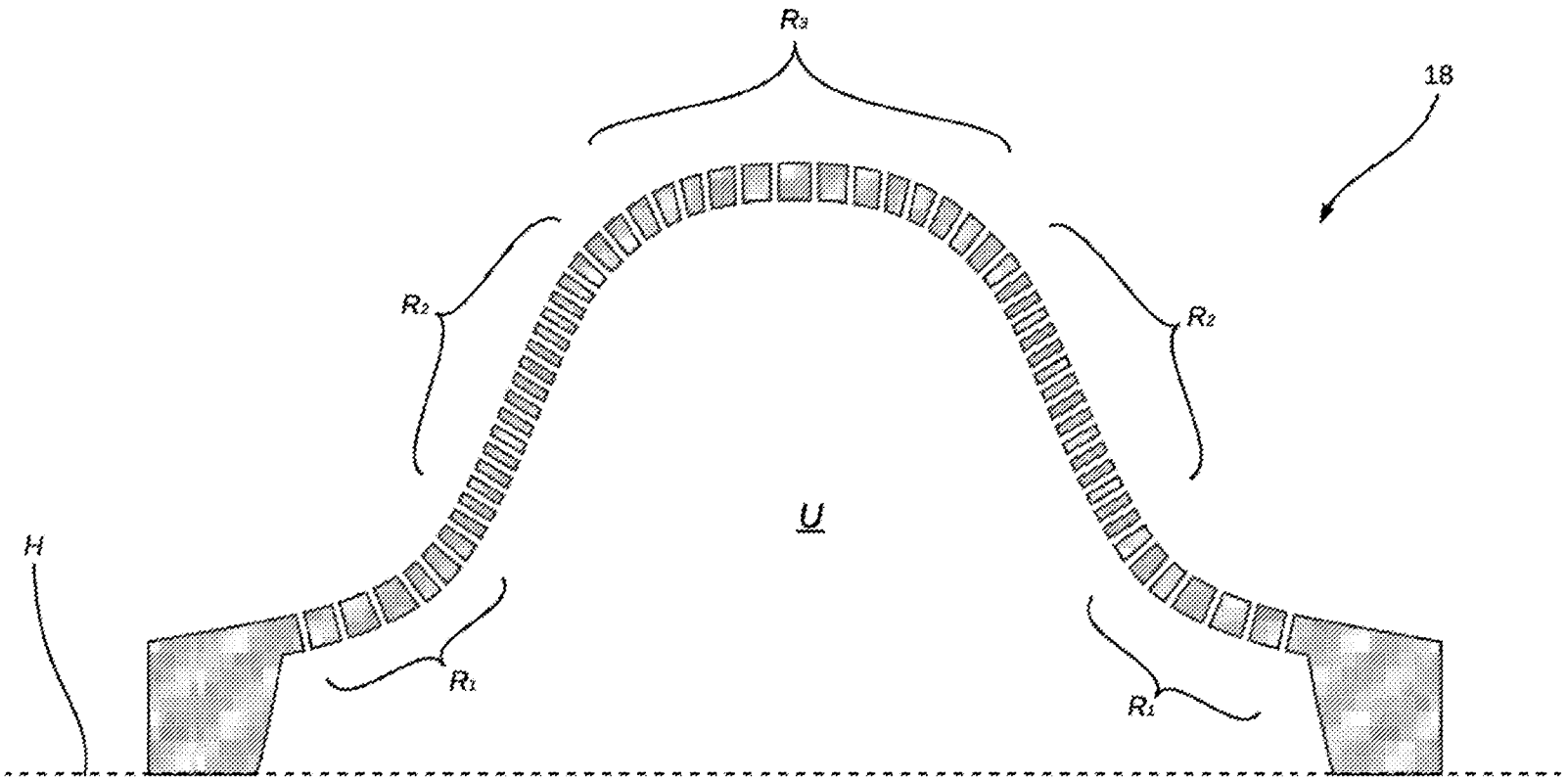
FIG. 7: is a schematic vertical cross-section view through one of the pre-form mould portions of the apparatus of FIG. 1.

In this embodiment, the porous mould includes a continuous belt assembly 16 that has pre-form moulds 18. The pre-form moulds 18 are porous (as indicated in FIG. 7, and described in further detail below). The pore size of the pre-form moulds 18 is such that fluid within the slurry S is able to pass through the pre-form moulds 18, but solid component(s) of the slurry S—including pulp fibres—are blocked from passing through the pre-form moulds 18.

The drive of the apparatus 10 is arranged to rotate the belt assembly 16 so as to move the pre-form moulds 18 relative to the outlet 14. The apparatus 10 is arranged such that the belt assembly 16 has a feed path (indicated by arrow F, in FIG. 1) during which pulp fibre slurry S is discharged onto the pre-form moulds 18, and a return path (indicated by arrow R, in FIG. 1).

The outlet 14 is arranged so that pulp fibre slurry is discharged from the outlet towards the porous mould in a curtain of pulp fibre slurry, as shown in FIGS. 2 and 3. Further, the outlet 14 is arranged so that the width of the curtain is generally transverse to the direction of movement of the porous mould relative to the outlet 14. In other words, the width of the curtain is transverse to the movement of the pre-form moulds 18 in the region in which slurry is to be deposited onto the pre-form moulds 18. In this way, slurry S is deposited laterally across the belt assembly 16, as the porous mould is moved relative to the outlet 14 along the feed path F. As will be appreciated, the apparatus 10 is configured so as to operate with slurry S within the source 12 that is of a flowable consistency.

For the purposes of this specification (including the claims that follows), references to a curtain of pulp fibre slurry are to be understood to mean a substantially continuous pour of pulp fibre slurry that is thin (in one direction that is generally orthogonal to the pour direction) and wide (in a second direction that is also generally orthogonal to the pour direction).

As particularly shown in FIG. 3, the apparatus 10 is configured so that each pre-form mould 18 is vertically beneath the outlet 14 when a slurry deposit is formed on the respective pre-form mould 18. Thus, the apparatus 10 is configured so that slurry S is transferred onto the pre-form moulds 18 by gravity. This enables continuous production of pre-forms in use of the apparatus 10.

Figure 5:
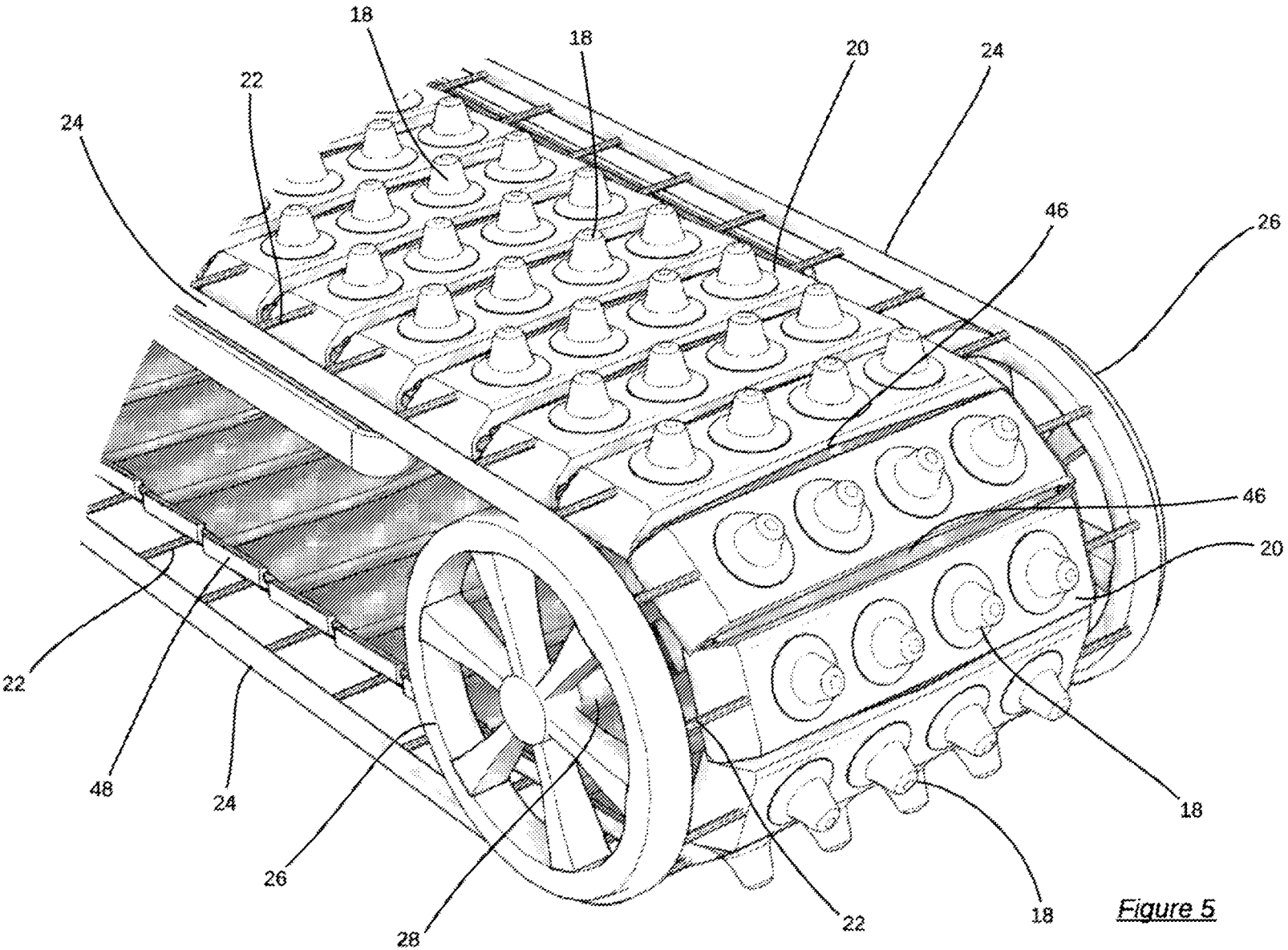
FIG. 5: is an enlarged view of Region V in FIG. 1.

The belt assembly 16 includes a set of carriage plates 20, as shown most clearly in FIG. 5. Each pre-form mould 18 is connected to one of the carriage plates 20. In this particular example, each carriage plate 20 carries four pre-form moulds 18. As previously described, each of the pre-form moulds 18 is porous so as to allow fluid to pass therethrough. The body of each carriage plate 20 has through-holes 21 that align with the pre-form moulds 18. In this example, the carriage plates 20 are made of non-porous material. In some examples, the pre-form moulds 18 are removably attached to the carriage plates 20. Alternatively, the pre-form moulds 18 can be integrally formed with the carriage plates 20.

As shown in FIG. 5, each carriage plate 20 has a pair of laterally protruding stub shafts 22. The outer ends of the stub shafts 22 connect to one of two endless toothed synchronous belt members 24 (which are illustrated schematically, and without the teeth, in the drawings). The drive of the apparatus 10 includes pairs of toothed timing wheels 26 at opposing ends of the feed path F/return path R. The belt members 24 extend around the timing wheels 26. In this way, the belt assembly 16 is supported by the drive. As will be apparent from FIG. 5, the belt members 24 are spaced laterally from the carriage plates 20, which has the benefit of spacing the belt members 24 from the pulp fibre slurry S.

The drive also includes two transverse shafts 28 that each interconnect one of the pairs of timing wheels 26, a drive motor (not shown) that is associated with one of the transverse shafts 28. The timing wheels 26 have teeth (not shown in the drawings) that mate with the teeth on the belt members 24. The drive motor is operated so as to cause the transverse shaft to rotate, and thus effect the movement of the belt assembly 16. Thus, the drive is configured to move the carriage plates 20 sequentially and substantially continuously along a loop that includes the feed path F, and the return path R.

Figure 6:
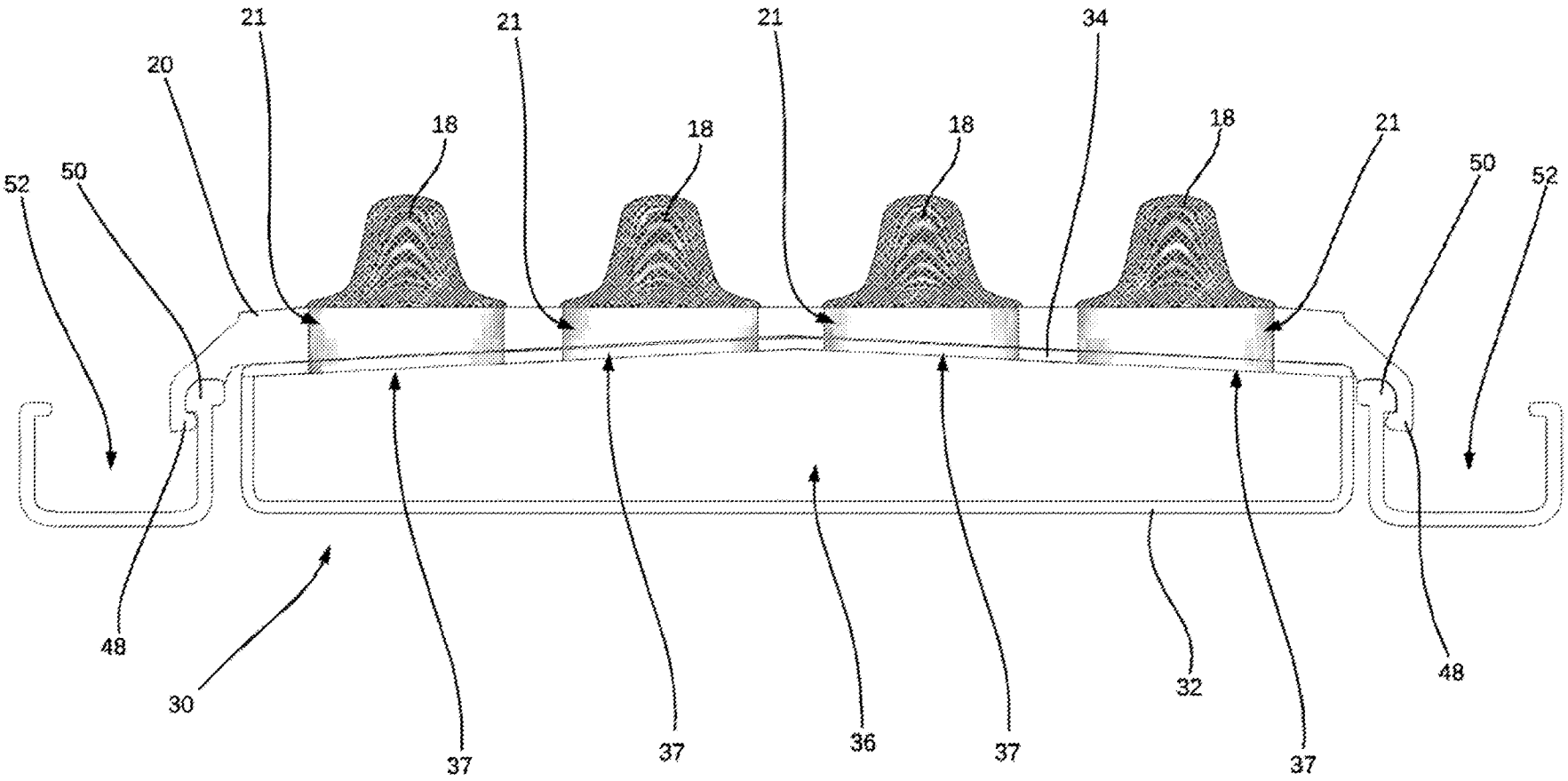
FIG. 6: is a section view of the apparatus as viewed along the line VI-VI in FIG. 3.

The apparatus 10 includes a belt support assembly 30, which is shown in FIG. 6. The belt support assembly 30 provides support to the belt assembly 16 within at least a portion of the feed path F. The belt support assembly 30 has a support bed, which in this embodiment is in the form of a vacuum box 32 with an upper wall 34. The carriage plates 20 traverse the vacuum box 32 as they progress along feed path F. During this traversal, the external surface of the upper wall 34 is in contact with the underside of carriage plates 20.

Figure 4:
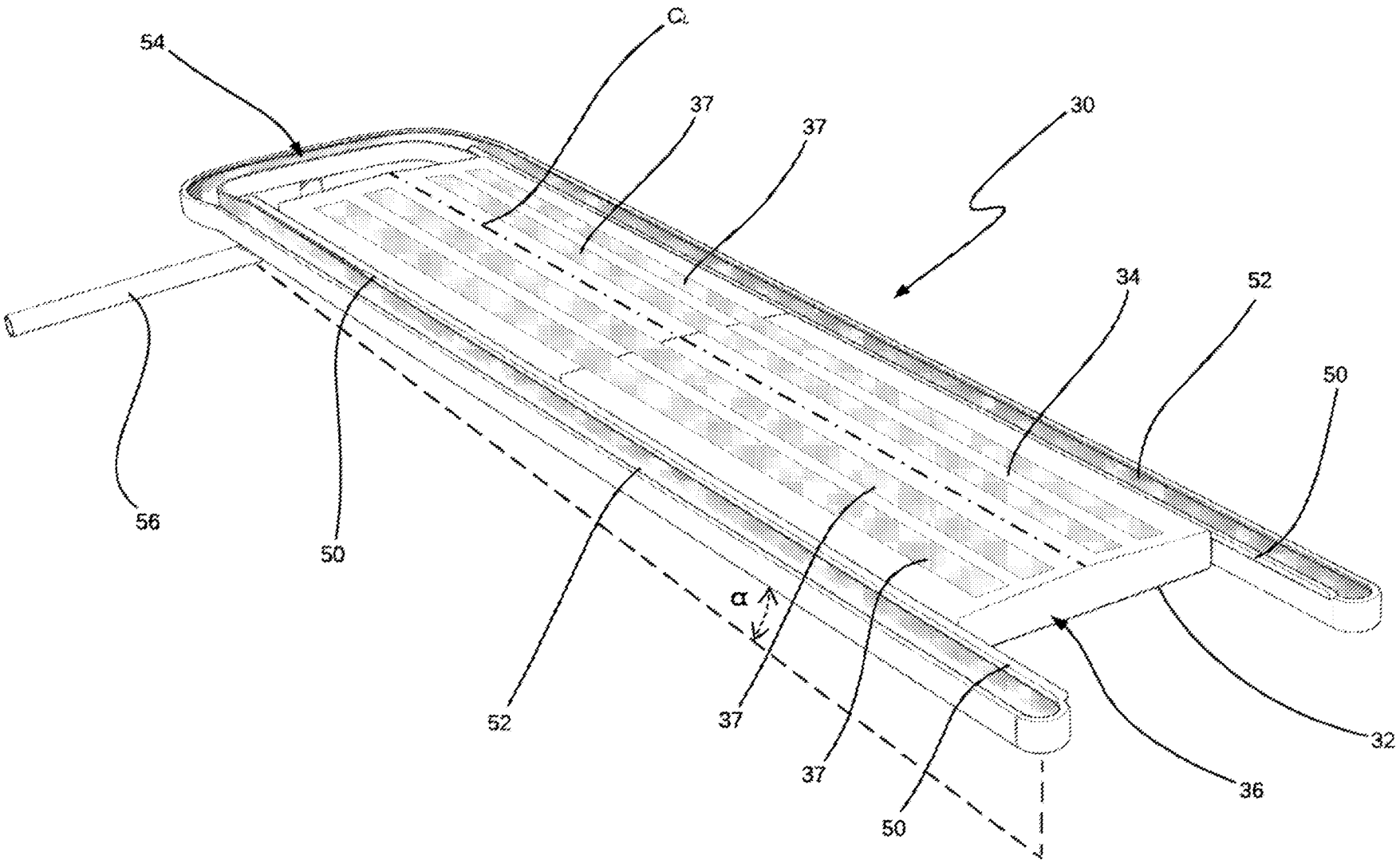
FIG. 4: is a perspective view of the support bed of the apparatus of FIG. 1.

The vacuum box 32 defines a plenum chamber 36 beneath the upper surface 34. The plenum chamber 36 is in communication with the fluid extraction system (as described in further detail below) such that in use of the apparatus 10, a low pressure is induced within the plenum chamber 36. As will be appreciated, the low pressure is a negative pressure relative to atmospheric pressure. The upper wall 34 has through-holes that enable fluid to be drawn into the plenum chamber 36. In this particular embodiment, the through-holes in the upper wall 34 are in the form of four elongate slots 37, as shown in FIG. 4. The elongate slots 37 align with the through-holes 21 in the carriage plates 20, as shown in FIG. 6. Consequently, in use of the apparatus 10, fluid is extracted from the slurry deposits, through the pre-form moulds 18, and is drawn into the plenum chamber 36. In this way, pre-forms are formed on the pre-form moulds 18.

In some alternative embodiments, the upper wall 34 can have a large number of narrow diameter through-holes. These through-holes can be arranged in sets that align with the through-holes 21 in the carriage plates 20. In such alternative embodiments, the diameter of the through-holes, and/or the density of through-holes per unit area can be varied along the vacuum box in the direction of the feed path. In this way, the suction pressure can be substantially constant along the vacuum box 32 in use of the apparatus 10. Alternatively, the suction pressure can be set to a predetermined profile along the vacuum box 32, in use of the apparatus 10. For example, the diameter of the through-holes can be selected to provide increasing suction pressure along the vacuum box 32 in the forward direction of the feed path F.

As indicated in FIG. 3, the vacuum box 32 is positioned so that suction is applied to the pre-form moulds 18 at, or slightly before, the point at which the pre-form moulds 18 pass through the curtain, having regard to the forward direction of movement of the carriage plates 20 along the feed path F. The length of the vacuum box 32 is such that suction is applied to the pre-form moulds 18 for a period after the pre-form moulds 18 pass through the curtain. As will be appreciated, this period is defined by the geometry of the vacuum box 32, and the speed at which the belt assembly 16 is driven.

The apparatus 10 is arranged such that a significant portion of liquid within the slurry deposits is removed at the point where the pre-forms reach the end of the feed path F. To this end, the ratio of solid-to-liquid in the pre-forms is sufficiently high at the end of the feed path F that the pre-forms are transferable to other processing equipment for further processing to form the desired moulded pulp fibre product.

As shown in FIG. 3, in this embodiment the fluid extraction system includes a duct 38, and a vacuum pump 40. The duct 38 has an inlet end 42 that is interconnected with the vacuum box 32, and an outlet end 44 that is interconnected with the vacuum pump 40. In use of the apparatus 10, the vacuum pump 40 is operated to induce a low pressure within the duct 38, and thus within the plenum chamber 36. In this way, the low pressure that is induced within the plenum chamber 36 draws fluid from a region immediately above the belt assembly 16 into the duct 38 via the plenum chamber 36 and the inlet end 42 for discharge at the outlet end 44. Consequently, the fluid component is greatly reduced to thereby retain pulp fibre against the pre-form moulds 18.

The belt assembly 16 includes a flexible substrate members 46 that each interconnect an adjacent pair of carriage plates 20. In this embodiment, the flexible substrate members 46 are attached to the underside of the carriage plates 20 at leading/trailing ends of the carriage plates 20. The flexible substrate members 46 are made of a non-porous material. Consequently, as the carriage plates 20 traverse the vacuum box 32, the flexible substrate members 46 are in contact with the upper surface of the vacuum box 32, and provide a seal against fluid being drawn into the plenum chamber 36 from between the carriage plates 20. In addition, the flexible substrate members 46 enable the adjacent carriage plates 20 to articulate with respect to one another as they transition between the feed and return paths F, R.

As shown in FIGS. 4 to 6, the belt assembly 16 and belt support assembly 30 are arranged to facilitate lateral alignment with one another through at least a portion of the feed path F. Each carriage plate 20 has one or more alignment formations, which in this embodiment are in the form of side plates 48 that are disposed on the lateral sides of the respective carriage plate 20. Further, the side plates 48 project in a direction that is generally away from the pre-form moulds 18. The belt support assembly 30 includes complementary elongate formations that co-operate with the side plates 48 to laterally align the carriage plates 20. In this particular embodiment, the complementary elongate formations are in the form of guide rails 50. As the carriage plates 20 progress along the feed path F, the side plates 48 engage with the guide rails 50 (as shown in FIGS. 4 and 6) to facilitate lateral alignment of the carriage plates 20 with belt support assembly 30, and thus also with the vacuum box 32. Further, the side plates 48 and guide rails 50 have complementary hooking formations that bring the carriage plates 20 into abutment with the external surface of the upper wall 34 of the vacuum box 32. This mitigates fluid being drawn into the plenum chamber 36 from between the carriage plates 20 and the vacuum box 32, in use of the apparatus 10.

As will be appreciated, in the illustrated example the process by which pulp fibre slurry S is transferred to the pre-form moulds 18 has an excess of slurry S being discharged from the outlet 14. The apparatus 10 is arranged to transport that excess slurry for reprocessing.

As the slurry S that is discharged from the source 12 is of a flowable consistency, excess slurry E—being the component of the discharged slurry S that is not retained against the pre-form moulds 18 by suction pressure and/or internal forces within the slurry—is able to flow across the carriage plates 20 and/or away from the pre-form moulds 18. As shown in FIG. 3, the apparatus 10 is arranged such that the feed path F is longitudinally inclined to the horizontal, as indicated by angle $\alpha$ in FIG. 3. In FIG. 3, the inclination of the feed path F is approximately 5°. As a consequence of this inclination, excess slurry E flows in the opposite direction to the movement of the belt assembly 16 along the feed path F.

In addition to the longitudinal inclination of the belt support assembly 30 (and thus also the vacuum box 32), the external surface of the upper wall 34 of the vacuum box 32 is sloped downwardly in a direction perpendicular to a centreline CI, of the belt support assembly 30. By virtue of the slope of the external surface of the upper wall 34, fluid drains away from the centreline CL (indicated in FIG. 4) of the vacuum box 32. The belt support assembly 30 includes a pair of lateral gutters 52 into which excess slurry E is received. As shown in FIGS. 3 and 4, the lower ends of the gutters 52 are brought together to form a sump 54 at which excess slurry E is collected for removal. As indicated in FIG. 3, the apparatus 10 can include a pulp fibre slurry run-off drainage and collection system 56 for receiving excess slurry E from the sump 54 and returning that slurry to the source 12.

As shown in FIG. 6, the underside surface of the carriage plates 20 is shaped to complement the shape of the external surface of the upper wall 34.

The apparatus 10 can additionally include a liquid spray system (not shown) that includes liquid discharge nozzles that are positioned downstream of the curtain. In use of the apparatus 10, the liquid spray system discharges liquid onto the slurry that has been deposited on the porous mould, which facilitates migration of excess slurry from the slurry deposits and/or the porous mould towards the gutters 52.

FIG. 7 shows a vertical cross section of an example pre-form mould 18, showing the solid material and pores that together enable fluid to pass through the pre-form mould 18, but inhibit passage of the pulp fibre. In this example, the pre-form mould 18 has three regions ($R_1$, $R_2$, $R_3$). In the illustrated example, the two of the regions $R_1$, $R_2$ are annular, with respect to the pre-form mould 18, and all three regions $R_1$, $R_2$, $R_3$ are concentric; however, it will be appreciated that these properties arise from the particular shape of the example pre-forms that are to be formed by the apparatus 10. In this particular example, pore density differs between the regions so as to provide differing maximum flow rate of fluid through the regions, in response to a substantially constant suction pressure applied to the underside U of the pre-form mould 18.

In this specification (including the claims that follows), the term "pore density" is to be understood to refer to the number of pores with respect to the surface area.

In this example, the pore density of the pre-form mould 18 is proportional to the local inclination of the outer surface of the pre-form mould 18, relative to a support plane that is defined by a surface of the carriage plate 20 (the support plane H is indicated in FIG. 7) to which the pre-form mould 18 is attached. In this particular example:

regions $R_1$, and $R_3$ have a low inclination relative to the support plane H, and correspondingly have a low pore density; and region $R_2$ has a high inclination relative to the support plane H, and correspondingly has a high pore density.

Figure 10:
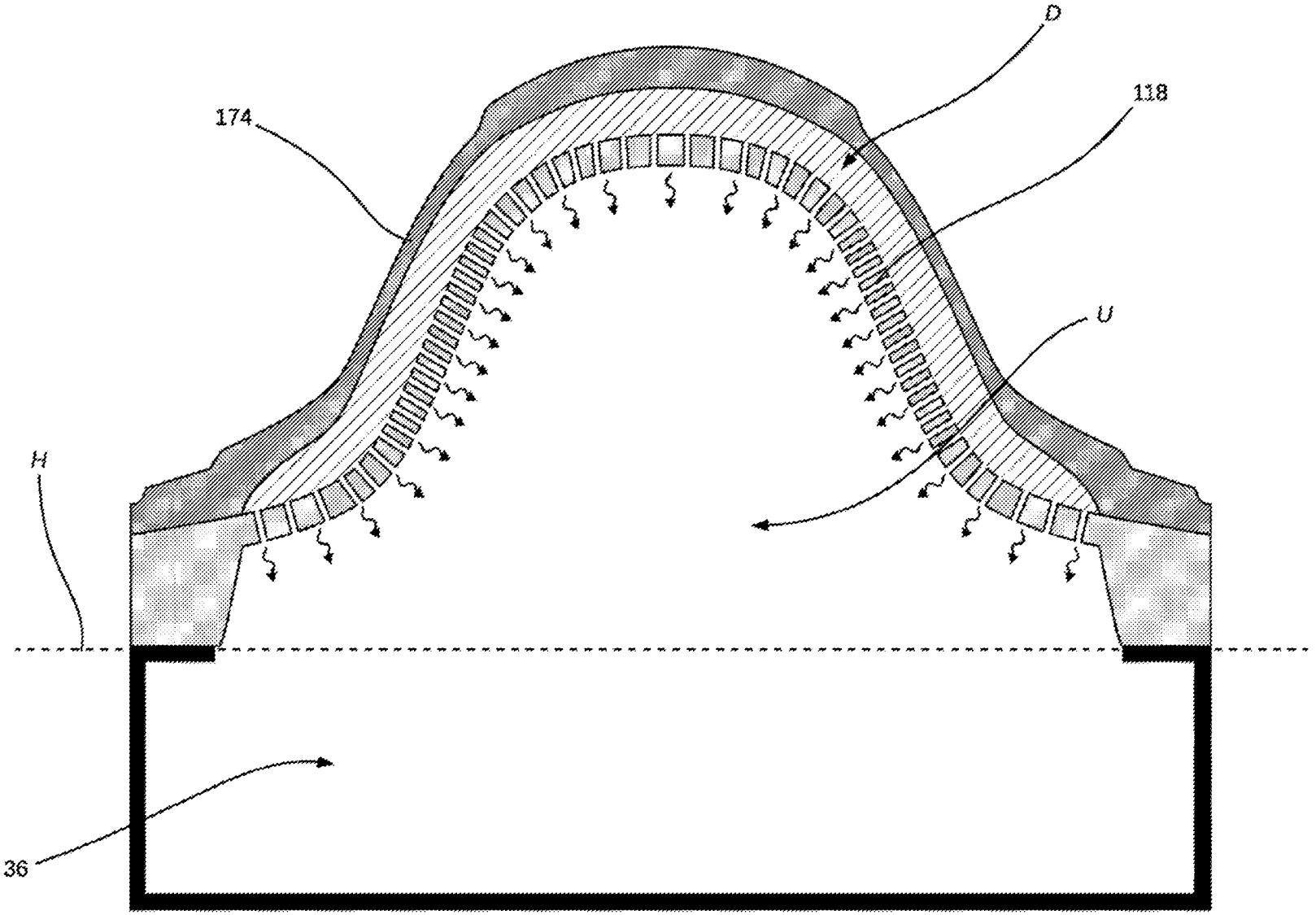
FIG. 10: is a schematic vertical cross-section view through one of the pre-form mould portions and receptacles of the apparatus of FIG. 8.

As will be appreciated, the pore density affects the volume of fluid and/or suction pressure that is applied to the slurry deposit (indicated in FIG. 10 by the sinusoidal arrows on the underside U of the pre-form mould 18). Providing higher pore density to region $R_2$, relative to that of regions $R_1$ and $R_3$, has the benefit of mitigating the propensity of slurry S to flow from those regions that have a higher inclination, relative to the support plane H.

Although the example pre-form mould 18 in FIG. 7 has varying pore density, it will be appreciated that in some alternative examples, the pore size of the pre-form mould can be varied, either alone or together with pore density.

As shown in FIG. 3, the apparatus 10 includes a blower 58 that directs heated air onto the slurry deposits D downstream of the curtain. The heated air facilitates removing liquid from the slurry deposits. To this end, some liquid from within the deposits is evaporated by the heated air. In some instances, the heated air is drawn through the slurry deposits by suction pressure, and facilitates removal of liquid.

The apparatus can include a cleaning station to remove residual slurry and/or pulp fibre that has not formed a pre-form and has been retained on the belt assembly 16.

As shown in FIG. 3, in this particular embodiment, the source 12 is in the form of a tank that has an inlet 60 through which slurry constituent materials are introduced. In addition, the source 12 includes a mixer 62 that is operated to maintain a substantially even dispersion of the slurry constituent materials.

Figure 8:
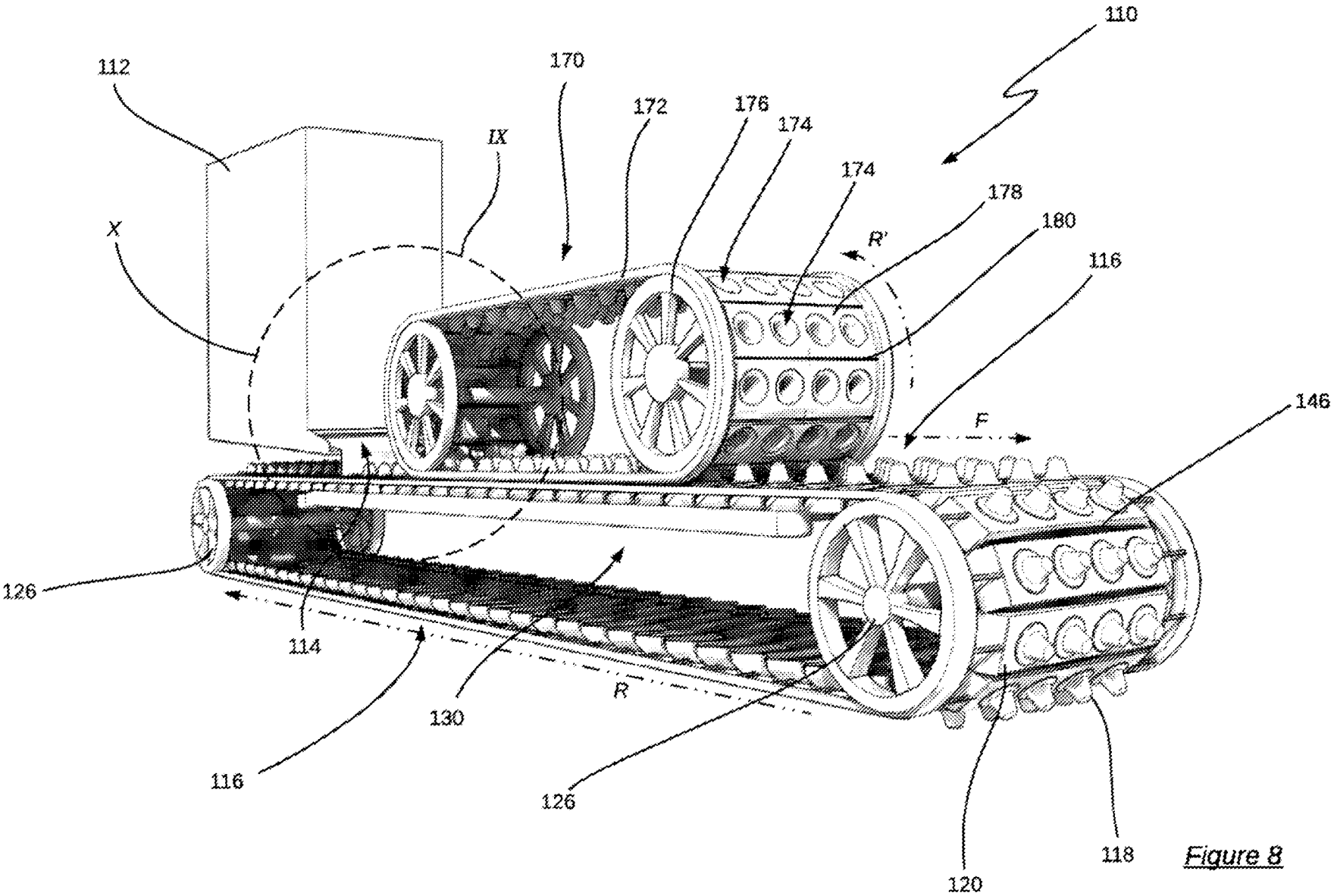
FIG. 8: is a perspective view of an apparatus for forming a pre-form for a moulded pulp fibre product, the apparatus being in accordance with a second embodiment of the present invention.
Figure 9:
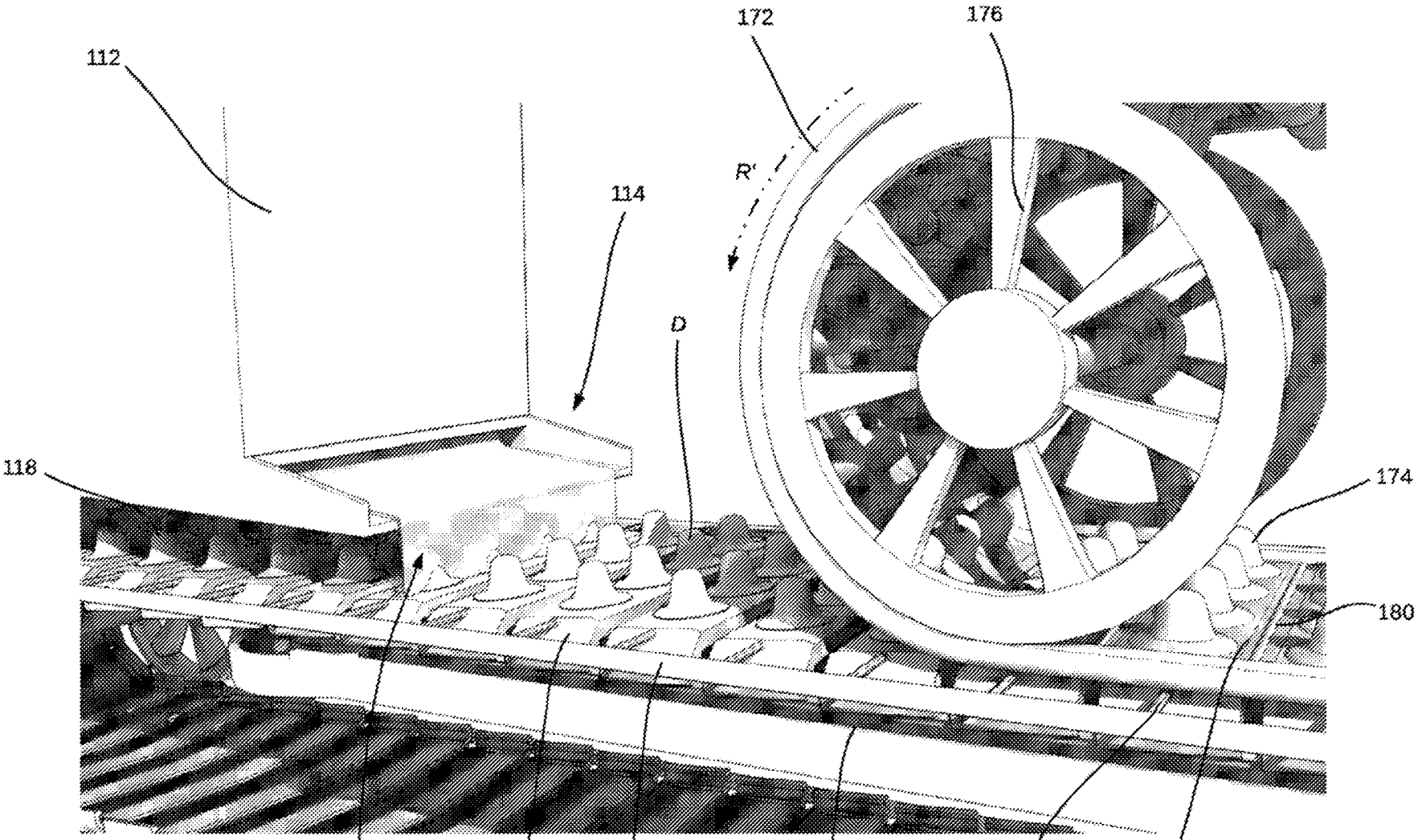
FIG. 9: is an enlarged view of Region IX in FIG. 8.

FIGS. 8 and 9 show an apparatus 110 for forming pre-forms for a moulded pulp fibre product, the apparatus being in accordance with an embodiment. The apparatus 110 has features and component parts that are similar to features and component parts of the apparatus 10 described and illustrated in FIGS. 1 to 8. Those similar features and component parts have the same reference numerals with the prefix "1". The apparatus 110 is substantially similar to the apparatus 10 shown in FIG. 1. Accordingly, components of the apparatus 110 that are similar to components of the apparatus 10 have the same number with the prefix "1".

The apparatus 110 has a conforming tool 170 that includes a belt 172 with a set of receptacles 174. In this particular embodiment, the conforming tool 170 includes two sets of rollers 176 about which the belt 172 is looped, so as to support the belt 172. Thus, the belt 172 travels around the rollers 176 in a direction indicated by arrow R' in FIGS. 8 and 9. Each receptacle 174 has a working surface with a shape that is complementary to the shape of the pre-form moulds 118. In the embodiment illustrated in FIG. 8, the working surfaces of the receptacles 174 are disposed to be radially outward with regard to the sets of rollers 176. The conforming tool 170 is configured to position the receptacles 174 on the outer surfaces of the slurry deposits D (the outer surfaces being those surfaces of the slurry deposits D that are opposite the pre-form mould 118), with the working surfaces contacting the surfaces of the slurry deposits D that are opposite the pre-form mould portions. In this way, each slurry deposit D is "sandwiched" between its pre-form mould 118 and one of the receptacles 174.

Each receptacle 174 is made of a material that is conformable and impermeable. Consequently, when the receptacle is in contact with the slurry deposit D, suction applied to the pre-form mould 118 by the fluid extraction system draws the receptacle 174 towards the pre-form mould 118, which has the effect of squeezing the slurry deposit D between the receptacle 174 and the pre-form mould 118. The squeezing has the further effect of mechanically wringing liquid from the slurry, which in turn reduces the thickness of the slurry deposit D.

Providing the conforming tool 170 can improve the performance of the fluid extraction system. This is because the conformable material of the receptacles 174 creates a seal against which the suction pressure is exerted. For each pre-form mould 118, slurry deposit D, and receptacle 174, the pressure differential that is created between the underside U and the atmosphere surrounding receptacle 174 causes the receptacle 174 to be drawn towards the pre-form mould 118 (as shown in FIG. 10), which can facilitate squeezing of the slurry deposit between the conformable material and the pre-form moulds 118.

The belt 172 is mounted so that the receptacles 174 move along the feed path F synchronously with the movement of pre-form moulds 118 along the feed path F.

As is evident from the Figures, the receptacles 174 are arranged in sets of four that are interconnected by a web portion 178 of the belt 172. Adjacent web portions 178 of the belt 172 are interconnected by hinge formations 180 that facilitate relative rotation of the web portions 178 as the belt 172 traverses the rollers 176.

The conforming tool 170 includes an alignment subsystem (not shown in the drawings) that is configured to adjust the longitudinal position of the receptacles 174 to maintain alignment of the receptacles 174 with the pre-form mould 118. Alternatively, the belt 172 and/or the rollers 176 can include detents that receive the stub shafts 122 of the belt assembly 116 as the receptacles 172 are located over the slurry deposits D. As will be appreciated, the detents facilitate longitudinal alignment of each set of receptacles 174 with the corresponding set of pre-form moulds 118. As will also be appreciated, the interaction of the stub shafts 112 with the detents enables the belt 172 of the conforming tool 170 to rotate at a desired speed.

As will be appreciated, during the process of positioning of the receptacles 174 on the slurry deposits D, it is desirable to mitigate unwanted contact between the slurry deposits D, and the receptacles 174 and/or the web portions 178; such unwanted contact can lead to deformation of the slurry deposits D prior to the receptacles being properly and completely positioned on the slurry deposits D. This is a significant issue because the pulp fibre slurry (at the point where the receptacles 174 are being positioned on the slurry deposits D) is effectively a collection of "mobile" pulp fibres that are held onto the pre-form mould 118 by suction pressure, and are therefore liable to be displaced by contact. This issue may be exacerbated as the height of the pre-form moulds 118 increase, and/or as the inclination of surfaces of the pre-form moulds 118 from the support plane H increase.

In the embodiment illustrated in FIGS. 8 and 9, the conforming tool 170 is designed so as to be able to resiliently stretch in the direction of the feed path F with engagement of the detents on the belt 172 with the stub shafts 112. Similarly, as the detents on the belt 172 disengage from the stub shafts 112. This stretching of the conforming tool 170 mitigates the unwanted contact described previously, and thus mitigates deformation of the slurry deposits D.

Further, in some embodiments the wall thickness of the receptacles 174 is shaped to provide varying rigidity (and conversely, varying elasticity, which leads to varying capacity to stretch) in different regions. The conforming tool 170 may have a small offset, in a direction orthogonal to the feed path F, which further reduces the risk of interference. In some examples, such as that shown in FIGS. 8 and 9, the conforming tool 170 can be configured to enable the receptacles 174 to collapse inwardly towards the pre-form moulds 118, thereby increasing the capacity to be drawn towards the pre-form moulds 118 by the suction pressure, in use of the apparatus 110. To this end, the receptacle 174 can include resilient folds (not shown) that are deformable so as to allow a substantial part of each receptacle 174 to be pulled down towards the pre-form moulds 118 by the suction pressure. The resilient folds can be located within either the receptacles 174 or the web portions 178, or at the intersection between the receptacles 174 and the web portions 178.

Figure 11:
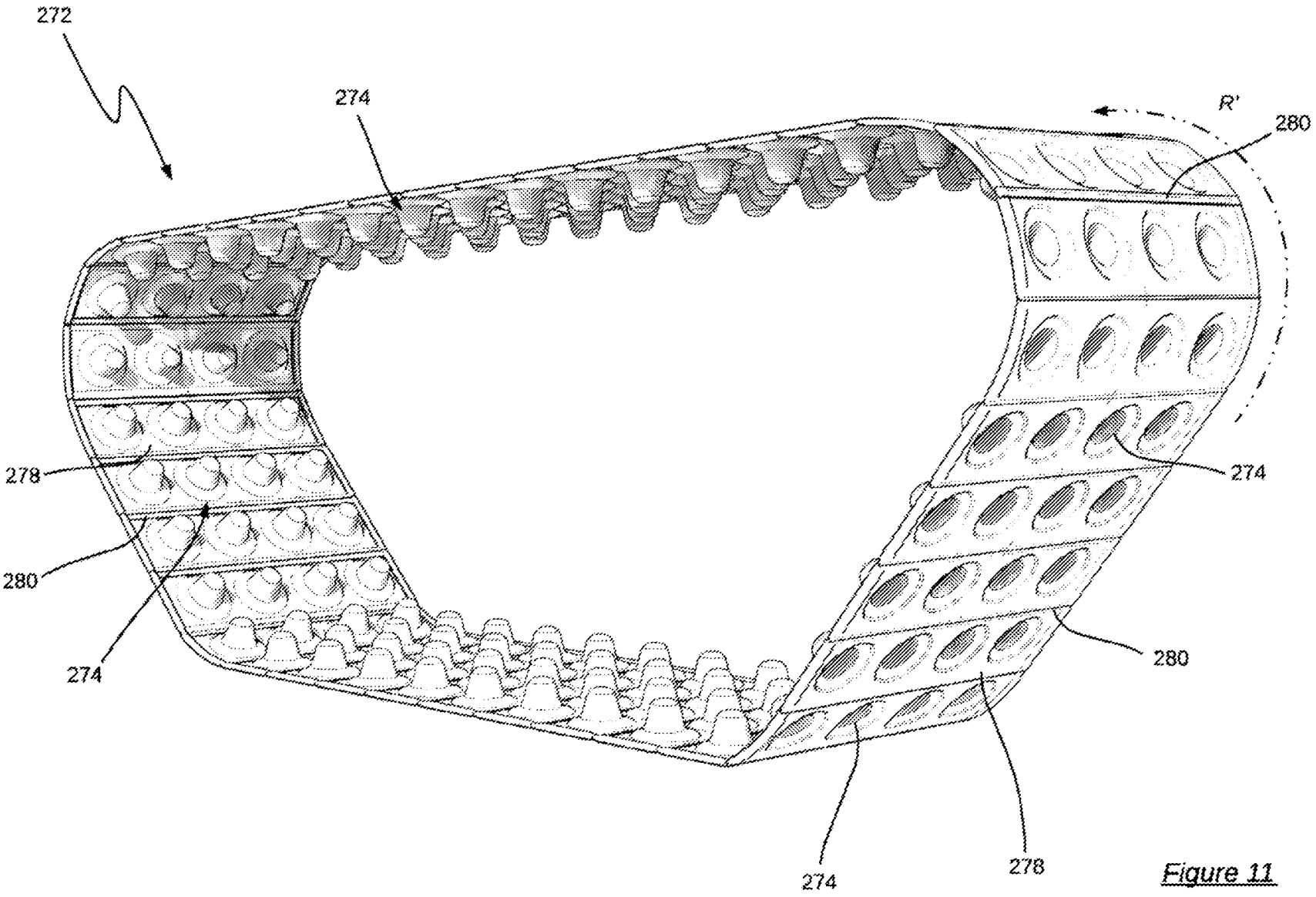
FIG. 11: is a perspective view of a conforming tool of a further embodiment of the present invention.
Figure 12:
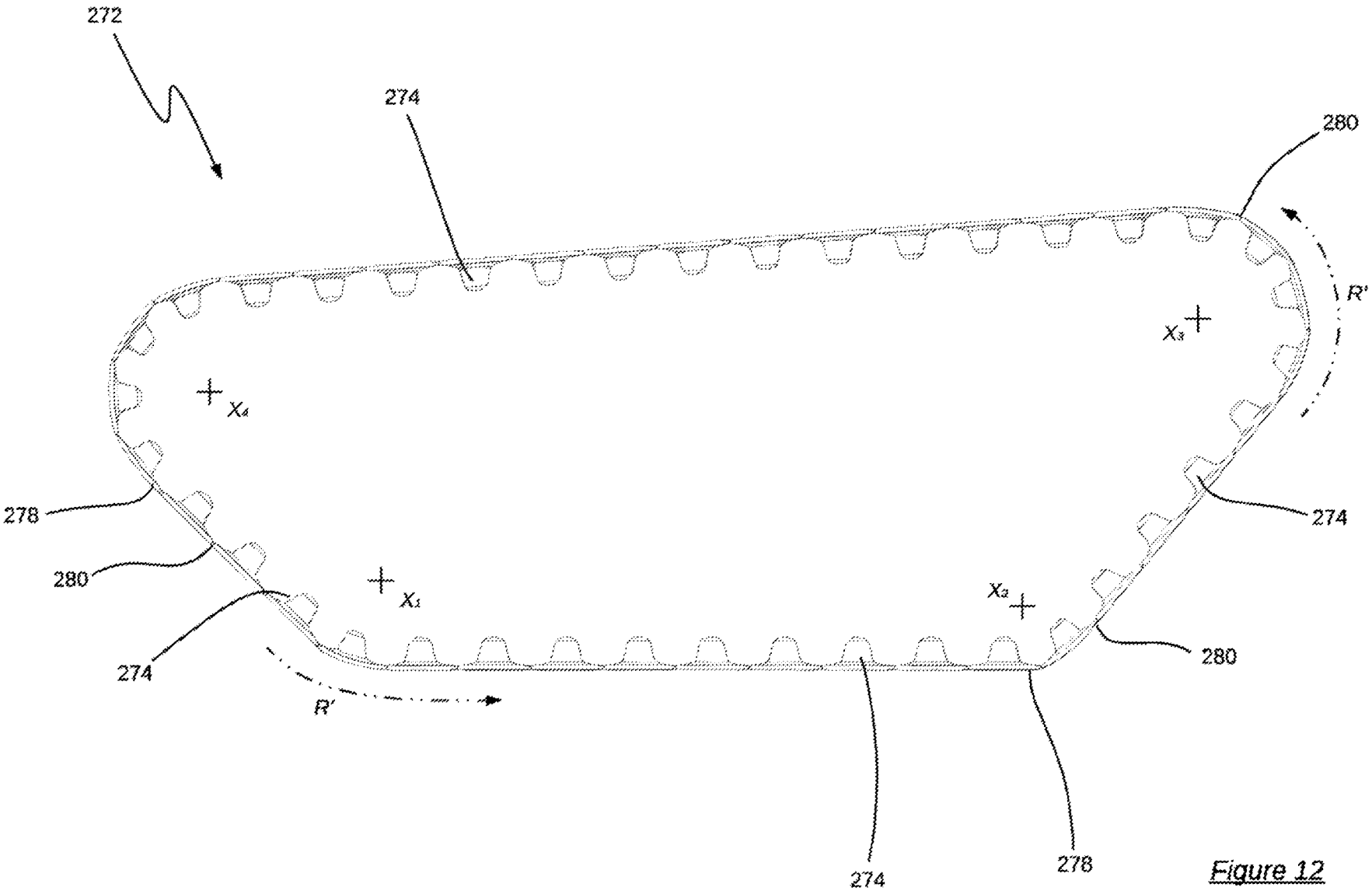
FIG. 12: is a side elevation view of the conforming tool of FIG. 11.

FIGS. 11 and 12 show a belt 272 of a conforming tool of a further embodiment. The belt 272 is substantially similar to the belt 172 described in connection with FIGS. 8 to 10. As shown particularly in FIG. 12, the belt 272 is to be used within an apparatus in which the conforming tool has four sets of rollers (not shown), with each set to be mounted for rotation at a respective one of four axial centres $X_1$, $X_2$, $X_3$, $X_4$. As is evident from FIG. 12, axial centres $X_1$ and $X_2$ are below axial centres $X_3$ and $X_4$. Further, the internal angle of the belt 272 adjacent the axial centres $X_1$ and $X_2$ is obtuse, whereas the internal angle of the belt 272 adjacent the axial centres $X_3$ and $X_4$ is acute. The belt 272 is to traverse the sets of rollers so as to sequentially pass axial centres $X_1$, $X_2$, $X_3$, $X_4$, as indicated by arrows R'; the portion of the belt 272 between the rollers mounted at axial centres $X_4$ and $X_1$ forms an entry side to a working portion of the belt 272 that is between axial centres $X_1$ and $X_2$. In addition, the portion of the belt 272 between the rollers mounted at axial centres $X_2$ and $X_3$ forms a departure side to the working portion of the belt 272. The obtuse internal angle of the belt 272 at each of the entry and departure sides can provide the benefit of mitigating distortion of the external surface of slurry deposits as the receptacles 274 are located on, and removed from, the slurry deposits at a more gradual angle; in other words, mitigating the unwanted contact between the receptacles 274 and the slurry deposits described above.

Figure 13:
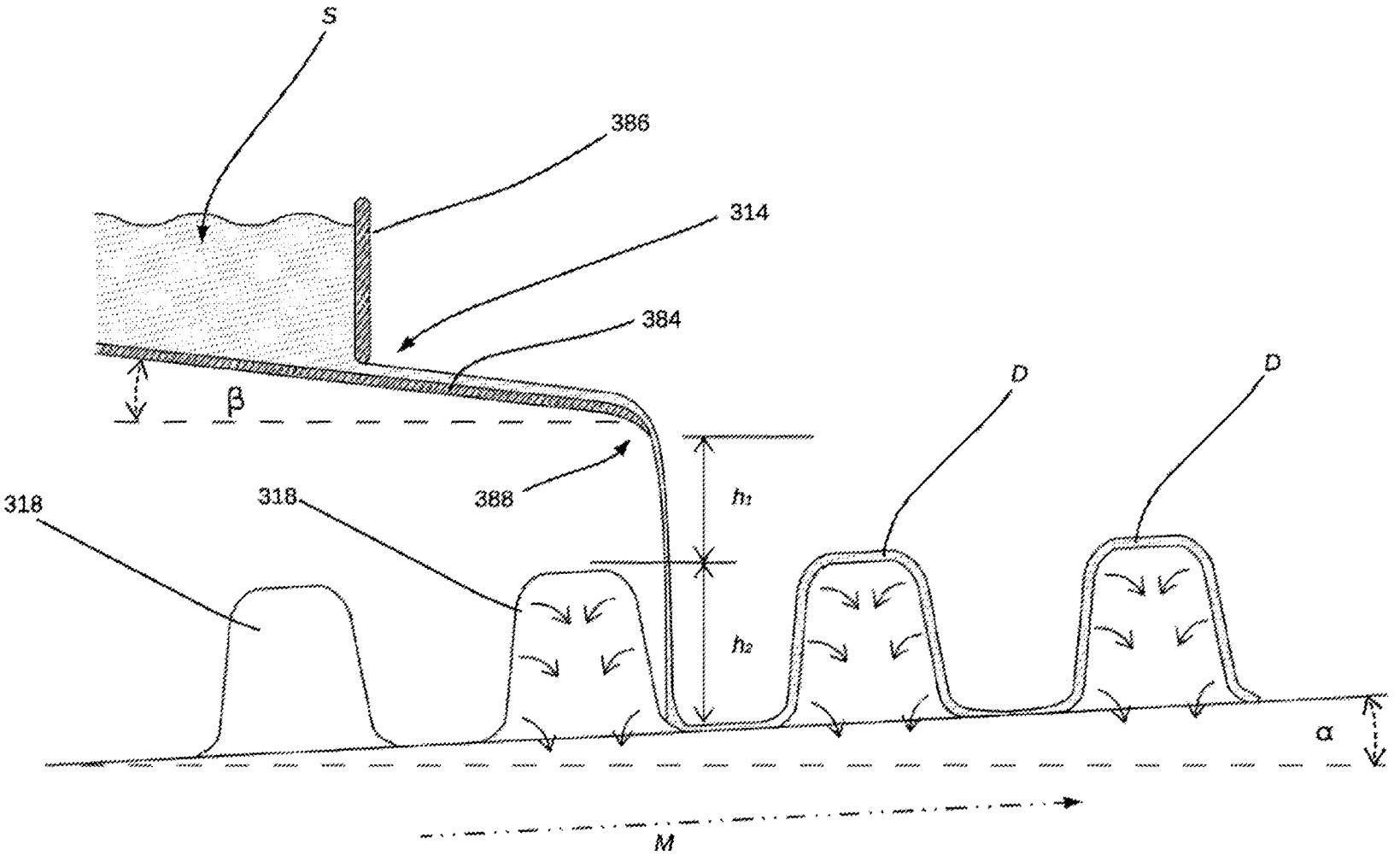
FIG. 13: is a schematic side elevation view of a portion of the feed path of an apparatus according to an embodiment of the present invention.

FIG. 13 is a schematic side elevation view of a portion of the feed path of an apparatus according to an embodiment. This figure shows factors that are considered particularly pertinent to the formation of slurry deposits on the pre-form moulds 318.

As previously described, the pre-form moulds 318 are moved along the feed path and through the curtain. In FIG. 13, the direction of movement is indicated by arrow M It is desirable for consistent formation of slurry deposits D that the slurry discharged from the outlet 314 has low turbidity. To minimize turbidity in the curtain of slurry, the outlet 314 can be provided at the end of a lip 384 that projects outwardly and downwardly from an orifice of the tank 386. The distal end 388 of the lip 384 is curved to limit the perturbation of the slurry leaving the lip 384.

There are number of factors that influence the rate of flow of slurry along the lip 384. One of these factors is the angle β, of the lip 384.

A further factor that is relevant to the formation of slurry deposits D is the height of the curtain relative to the surface of the pre-form moulds 318. In this example, the minimum height of the curtain corresponds with the minimum separation $h_1$ of the pre-form moulds 118 from the distal end 388 of the lip 384. The maximum height of the curtain corresponds with the minimum separation $h_1$ plus the maximum height $h_2$ of the pre-form moulds 118.

In some instances, where the maximum height $h_2$ of the pre-form moulds is greater than the minimum separation $h_1$ of the pre-form moulds 318 from the distal end 388 of the lip 384, it may be beneficial to vary the vertical position of outlet 314 in use of the apparatus while the pre-form moulds 318 are moving, and slurry S is being discharged from the outlet 314. To this end, variation of the vertical position of the outlet 314 would be dependent on several factors, including (but not limited to) the speed of the pre-form moulds 318 in the direction indicated by arrow M, and/or the particular shape of the pre-form moulds 318.

Figure 14:
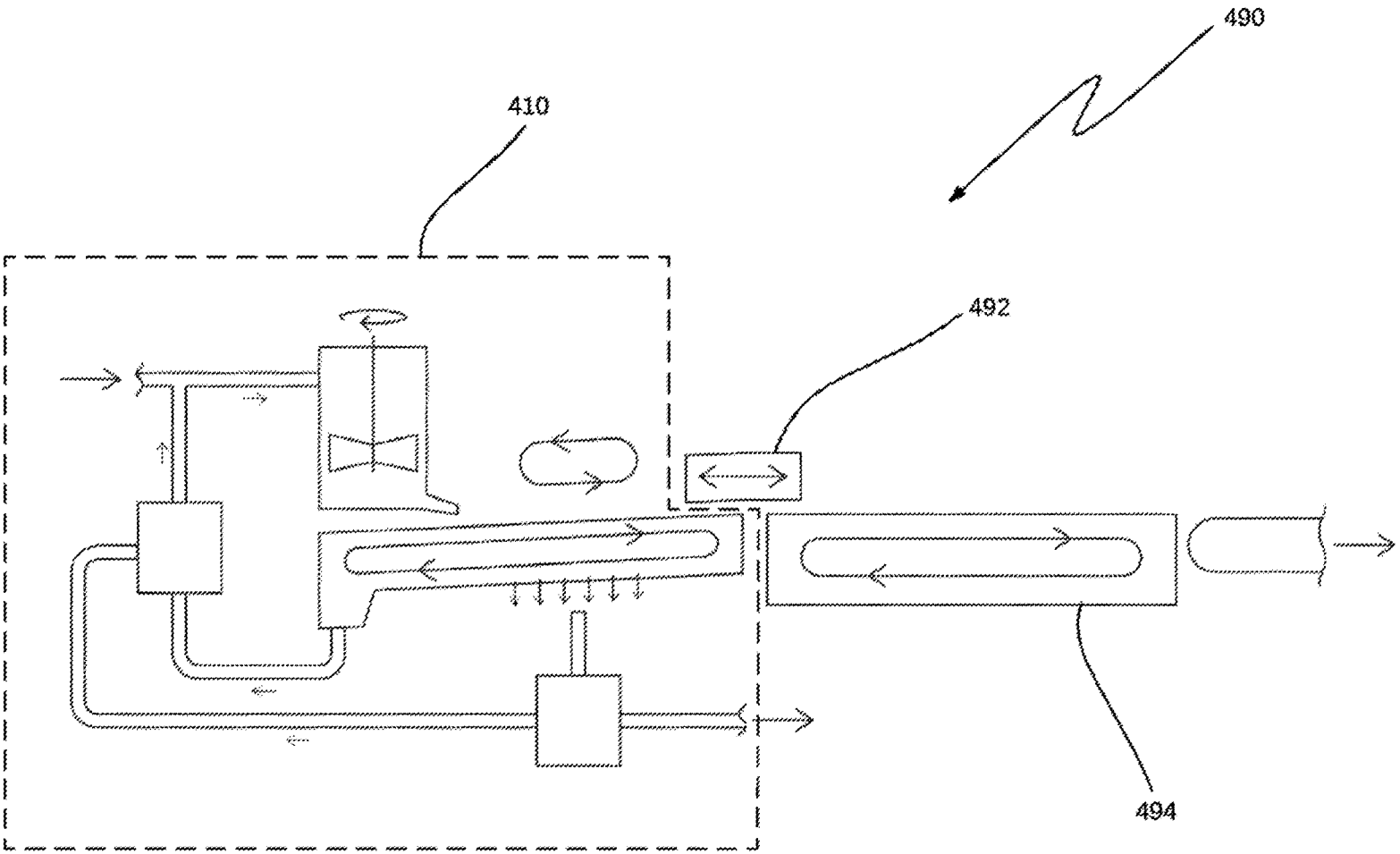
FIG. 14: is a schematic process flow diagram of a system for forming a moulded pulp fibre product according to a first embodiment of the present invention.

FIG. 14 is a schematic process flow diagram of a system 490 for forming moulded pulp fibre products. The system 490 includes an apparatus 410 for forming pre-form moulds. The apparatus 410 is substantially similar to the apparatus 110 and for brevity will not be described in detail. The system 490 includes a transfer station 492, and a curing apparatus 494. The transfer station 492 collects pre-forms from the apparatus 410 and delivers these to the curing station 494. In one example, the curing apparatus 494 includes a secondary toolset that has two complementary shaped surfaces between which the pre-forms are loaded.

The secondary toolset of the curing apparatus 494 can be heated so as to transfer heat to the pre-forms. In addition, the pre-forms can be pressed between the two complementary surfaces. In this way, liquid within the pre-forms can be removed, thereby curing the pre-forms to form the moulded pulp fibre products.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A system for forming moulded pulp fibre products, the system comprising:

a pre-form forming apparatus including:

a porous mould having one or more pre-form mould portions that each have an outer surface corresponding to a surface of the pre-form, wherein each of the one or more pre-form mould portions includes two or more regions, wherein the pore size and/or pore density differs between the two or more regions such that respective maximum flow rates of fluid through the two or more regions differ, a source of pulp fibre slurry, and an outlet that is in communication with the source such that pulp fibre slurry from the source is to be discharged from the outlet towards the porous mould in a curtain of pulp fibre slurry, a drive that is arranged to move the porous mould relative to the outlet and/or the outlet relative to the porous mould such that pulp fibre slurry discharged from the outlet forms slurry deposits for the pre-forms on the outer surfaces of the pre-form mould portions, and a fluid extraction system that is configured to extract fluid from the slurry deposits through the porous mould to thereby form the pre-forms, a curing apparatus that includes a secondary toolset that has two complementary shaped surfaces between which the pre-forms are loaded, the curing apparatus being configured to remove liquid from the pre-forms, thereby curing the pre-forms to form the moulded pulp fibre products, and a transfer station that is configured to collect pre-forms formed by the pre-form forming apparatus and deliver collected pre-forms to the curing apparatus.

2. The system according to claim 1, wherein the secondary toolset of the curing apparatus is heated so as to transfer heat to the pre- forms.

3. The system according to claim 1, wherein the secondary toolset of the curing apparatus is configured to press the pre-forms between the two complementary surfaces.

4. The system according to claim 1, wherein the outlet is arranged so that the width of the curtain is generally transverse to the direction of movement of the porous mould relative to the outlet.

5. The system according to claim 1, wherein the pre-form mould portions are part of a continuous belt assembly that is driven by the drive to move the pre-form mould portions relative to the outlet.

6. The system according to claim 5, wherein the belt assembly is arranged to have a feed path during which pulp fibre slurry is discharged onto the pre-form mould portions, and a return path.

7. The system according to claim 5, further comprising:

a belt support assembly that is arranged to support the belt assembly within at least a first portion of the feed path, wherein the belt support assembly has an upper surface that slopes in a direction perpendicular to a centreline of the belt support assembly such that fluid drains away from the centreline, and wherein the first portion of the feed path includes a region that is beneath the outlet.

8. The system according to claim 5, wherein at least a portion of the feed path is arranged such that the pre-form mould portions rise as they pass beneath the outlet.

9. The system according to claim 5, wherein the fluid extraction system includes:

a duct that has an inlet end that is positioned to receive fluid from slurry deposits that are on the pre-form mould portions, and an outlet end; and a vacuum pump that is interconnected with the outlet end of the duct, the vacuum pump is operable to induce a low pressure within the duct, wherein, in use of the apparatus, low pressure induced within the duct draws fluid from a region immediately above the porous mould and into the duct via the inlet end for discharge at the outlet end, to thereby retain pulp fibre from the slurry deposits against the pre-form mould portions.

10. The system according to claim 5, wherein a support bed across which the belt assembly is to traverse, the support bed extending along at least a support bed portion of the feed path, wherein the support bed portion includes a vertical plane that is transverse to the feed path and coincident with the outlet, and wherein the support bed has a plenum chamber, and one or more through-holes such that the plenum chamber is in communication with the region immediately above the belt assembly.

11. The system according to claim 10, wherein the diameter of the through-holes is selected such that, in use of the apparatus, the suction pressure is substantially constant along the support bed portion in the forward direction of the feed path.

12. The system according to claim 1, wherein the pore size and/or pore density of each pre-form mould portion is proportional to the local inclination of the outer surface of the respective pre-form mould portion to a support plane that is defined by a surface of the belt assembly to which the respective pre-form mould portion is attached.

13. The system according to claim 12, wherein the pore size and/or pore density of each pre-form mould portion increases with increasing local inclination of the outer surface of the respective pre-form mould portion relative to the support plane.

14. The system according to claim 1, wherein the pore size differs between the two or more regions such that respective maximum flow rates of fluid through the two or more regions differ.

15. The system according to claim 1, wherein the pore density differs between the two or more regions such that respective maximum flow rates of fluid through the two or more regions differ.

* * * * *